United States Patent [19]

Kimura et al.

[11] Patent Number: 4,647,394

[45] Date of Patent: Mar. 3, 1987

[54] SOAP COMPOSITION

[75] Inventors: Kuniko Kimura, Tokyo; Kunihiko Ofuchi; Koichiro Oda, both of Yokohama, all of Japan

[73] Assignee: Mitsubishi Chemical Industries Limited, Tokyo, Japan

[21] Appl. No.: 666,139

[22] Filed: Oct. 31, 1984

Related U.S. Application Data

[62] Division of Ser. No. 359,945, Mar. 19, 1982, abandoned.

[30] Foreign Application Priority Data

Apr. 7, 1981 [JP] Japan ..... 56-52015
Aug. 28, 1981 [JP] Japan ..... 56-135247

[51] Int. Cl.[4] ..... C11D 9/34; C11D 9/39; C11D 9/48

[52] U.S. Cl. ..... 252/117; 252/132; 252/134; 252/174; 252/545; 252/DIG. 16; 424/73

[58] Field of Search ..... 252/108, 117, 132, 134, 252/174, DIG. 16; 424/73

[56] References Cited

U.S. PATENT DOCUMENTS

| | | | |
|---|---|---|---|
| 2,164,717 | 7/1939 | Kritchevsky | 424/73 |
| 2,185,255 | 1/1940 | Kroper | 424/73 |
| 2,385,614 | 9/1945 | Dreger et al. | 252/DIG. 16 |
| 2,423,638 | 7/1947 | Clayton | 252/367 |
| 2,781,320 | 2/1957 | Jelinek | 252/DIG. 16 |
| 2,781,321 | 2/1957 | Mayhew | 252/550 |
| 3,070,547 | 12/1962 | Chaffee | 252/121 |
| 3,179,596 | 4/1965 | Farrar et al. | 252/132 |
| 3,224,976 | 12/1965 | Farrar et al. | 252/DIG. 16 |
| 3,660,566 | 5/1972 | Vinson et al. | 252/DIG. 16 |
| 3,793,214 | 2/1974 | O'Neill | 252/117 |
| 3,862,965 | 1/1975 | Werner et al. | 252/557 |
| 3,901,832 | 8/1975 | Dugan et al. | 252/DIG. 16 |
| 3,941,712 | 3/1976 | Ferrara | 252/134 |
| 4,115,313 | 9/1978 | Lyon et al. | 252/117 |
| 4,151,105 | 4/1979 | O'Roark | 252/DIG. 16 |
| 4,169,066 | 9/1979 | Joshi | 252/132 |
| 4,205,062 | 5/1980 | Dähn | 252/108 |
| 4,273,684 | 6/1981 | Nagashima | 252/544 |
| 4,279,765 | 7/1981 | Hill et al. | 252/117 |
| 4,333,927 | 6/1982 | Ofuchi et al. | 424/238 |

*Primary Examiner*—Dennis L. Albrecht
*Attorney, Agent, or Firm*—Oblon, Fisher, Spivak, McClelland & Maier

[57] ABSTRACT

A soap composition comprising a blend of a solid soap base and a phospholipid is disclosed.

2 Claims, No Drawings

SOAP COMPOSITION

This application is a division of application Ser. No. 359,945, filed Mar. 19, 1982, now abandoned.

BACKGROUND OF THE INVENTION

1. Field of the Invention

This invention relates to a soap composition. More particularly, this invention relates to a soap composition, which gives less irritation to the skin and an excellent feel after its use.

2. Description of the Prior Art

Various proposals have heretofore been made for the purpose of improving performance of solid soap. However, there is a continuing need to find soap compositions which gives less irritation to the skin and an excellent feel after its use.

SUMMARY OF THE INVENTION

The soap composition of this invention comprises a blend of solid soap base and a phospholipid and, when formed into soap, is extremely mild and smooth to the touch without a feel of stiffening the skin.

DESCRIPTION OF THE PREFERRED EMBODIMENTS

First of all, usuable as the solid soap bases in the present invention are those which are commonly used as detergents such as salts of fatty acids, lauryl sulfates, N-acylglutamates and the like.

Usuable as the salts of a fatty acid are those which are commonly used as soap base, and they usually include alkali metal salts, ammonium salts and organic basic salts of saturated or unsaturated fatty acid of $C_8$–$C_{22}$ or thereabouts.

Usable alkali metal salts include sodium salts and potassium salts, and organic basic salts include salts of triethanolamine, diisopropanolamine, guanidine, etc.

As the lauryl sulfate, sodium laurylsulfate is preferred and as the N-acylglutamate, sodium N-acylglutamate is preferred.

Usable as the phospholipid are, for example, phosphatidylcholine (lecithine), phosphatidylethanolamine (cephaline), phosphatidylserine, phosphatidylinocitol, phosphatidic acid, etc. Mixtures comprising two or more substances mentioned above are also usable. In such case, however, the mixture comprising phosphatidylcholine amounting to about 10 to 40% in the phospholipid is most preferred.

In practical application, it is of advantage to use soybean phospholipid and egg phospholipid as the phospholipid.

The amount of phospholipid to be blended in soap as a product is usually from 0.1 to 10% or thereabouts, preferably 0.3 to 5% and preferably 0.5 to 3% by weight or thereabouts.

The use of phospholipid in an amount exceeding 10% by weight is not preferred as being in danger of deteriorating detergency and bringing about trouble from the point of stability of the finished product soap.

In practicing the blending of components necessary for preparing present composition, because of the possibility of the phospholipid undergoing hydrolysis in the presence of alkali, the addition of phospholipid is not effected at the time when the saponification reaction of fats and oils with alkali is carried out, said reaction being a first step of soapmaking process, and the phospholipid is usually incorporated into a soap base prior to steps of mixing colors and scenting, i.e. a finishing stage of the soapmaking process.

In order to avert completely the phospholipid from a danger of hydroloysis with excess alkali, moreover, there is adopted more preferably such procedure that the phospholipid is previously dissolved at a temperature ranging from room temperature to about 70° C. in a substrate which is stable to alkali and which is oil soluble, and the resulting solution is then incorporated into the soap base by mixing.

Suitable as the substrate used in the above-mentioned procedure, are paraffin hydrocarbons of at least 5 carbon atoms and/or fatty acid esters.

Preferable as the paraffin hydrocarbons referred to above are particularly those which have 15 or more carbon atoms and which at ordinary temperature are in a liquid or paste-like state. These paraffin hydrocarbons may be of either straight-chain or side-chain, or may be of cyclic (i.e. cyclo-paraffins), or may be mixtures thereof. Concretely, usable paraffin hydrocarbons are, for example, liquid paraffin, paraffin wax, squalane, etc.

The fatty acid ester includes a primary higher alcohol ester of a higher fatty acid. As the fatty acid, there may be mentioned the one having from 8 to 26 carbon atoms, preferably from 12 to 18 carbon atoms. If the carbon atoms are less than 8, such a fatty acid tends to give irritation to the skin. On the other hand, if the carbon atoms are more than 26, such a fatty acid is not preferred because of its poor feeling when applied to the skin.

Namely, as the fatty acid, there may be mentioned, for instance, a saturated fatty acids such as lauric acid, tridecylic acid, myristic acid or palmitic acid, or an unsaturated fatty acid such as oleic acid or ricinoleic acid. Whereas, as the above mentioned alcohol, there may be mentioned, the one having from 8 to 22 carbon atoms, such as dodecyl alcohol, myristyl alcohol, stearyl alcohol, octyldodecyl alcohol, hexadecyl alcohol, or cetyl alcohol. Among them, the branched alcohols are preferred to the straight chained alcohols, since they have a low solidifying point and a high boiling point and thus are stable in the air. As such a branched alcohols, there may be mentioned, for instance, hexadecyl alcohol or octyldodecyl alcohol.

Namely, as the fatty acid ester, octyldodecyl myristate, octyldodecyl oleate, octyldodecyl ricinoleate or hexyldecyl dimethyloctanoate is preferably used.

The amount of the paraffin hydrocarbon and/or the fatty acid ester to be used is selected in such a manner that the hydrocarbon present in soap may usually amount to from about 0.1 to about 5% by weight.

The present composition, when subjected to the soapmaking process, may be additionally incorporated with other ingredients, according to the purpose for which the composition is used, in the usual way. Such additional ingredients may include, for example, superfatting agents such as higher alcohols, higher fatty acids, etc. for making lather creamy, agents preventing skin chaps such as sulfur, ε-aminocapronic acid, vitamins, etc., disinfectants such as chlorocresol, etc., pH buffers, water softeners, polyhydric alcohols, clarifying agents such as sucrose, etc., various chelating agents, and others such as perfume, dye, etc.

The following are distinct features of the compositions of the present invention.

(i) Because of its property of being extremely low in skin irritation, the present composition, when formed into soap, is applicable even to any person having a sensitive skin.

(ii) The present composition, when formed into soap, lathers finely and gives a creamy and dry feel.

(iii) The present composition, when formed into soap, lathers well.

(iv) After use of the present composition, when formed into soap, one who used it feels excellent.

That is, the present composition, when formed into soap, is extremely mild and smooth to the touch without a feel of stiffening the skin.

The present invention is illustrated below in detail with reference to examples which are not intended to limit the scope of the invention except as indicated by the appended claims.

In the example, all percentages are given by weight.

REFERENCE EXAMPLE (Transparent soap)

Soybean phospholipid: 2%
Stearic acid: 14
Beef tallow: 12
Coconut oil: 8
Glycerin: 9
Castor oil: 8
Triethanolamine: 28
Sodium hydroxide: 3
Purified water: 10
Ethanol: 6

A fluid soap base was obtained, according to usual method, from the above-mentioned ingredients except the soybean phospholipid, and the soap base thus obtained was then mixed with the soybean phospholipid to obtain a uniform mixture. This mixture was poured into a molding frame and, after cooling to solidity, the solidified soap base was stamped and then given the finishing touch to obtain transparent soap. The transparent soap thus obtained was found to be less irritative and make the skin feel smooth after use.

EXAMPLE 2

(Transparent soap)

Soybean phospholipid: 1%
Squalane: 0.5
Beef tallow: 22%
Coconut oil: 9
Olive oil: 7.5
Sodium hydroxide: 6
Ethyl alcohol: 18
Sucrose: 9
Glycerin: 6
Perfume: 1
Coloring matter: Suitable amount
E D T A: Suitable amount
Purified water: 20

A soap base was obtained, according to the usual method, from the above-mentioned ingredients except the soybean phospholipid and squalane. In this case, a solution of the soybean phospholipid in squalane was incorporated, prior to color mixing and scenting steps, into the soap base. The thus obtained transparent soap was found to be less irritative and also favorable to the feel after use.

EXAMPLE 3

(Toilet soap)

Soap base: 92.5%
Soybean phospholipid: 5
Liquid paraffin (#70): 2.5
E D T A: Suitable amount
B H T: Suitable amount
Perfume: Suitable amount A solution of the soybean phospholipid in the liquid paraffin was incorporated, prior to scenting step, into the soap base to obtain toilet soap. The thus obtained toilet soap was found to have the expected effect.

EXAMPLE 4

(Transparent soap)

Egg phospholipid (Egg oil): 0.5%
Liquid paraffin (#70): 0.25
Stearic acid: 14
Palmitic acid: 4
Beef tallow: 15
Castor oil: 3.25
Coconut oil: 10
Glycerin: 9
Triethanolamine: 27
Sodium hydroxide: 3
Ethanol: 4
Purified water: 10

Following a procedure similar to that of Example 2 and using the solution of the egg phospholipid in the liquid paraffin, transparent soap was obtained. The thus obtained soap was found to be less irritative and excellent to the feel after use.

EXAMPLE 5

(Transparent soap)

Soybean phospholipid: 2%
2-octyldodecyl myristate: 2.0
Stearic acid: 12
Beef tallow: 11.9
Coconut oil: 8
Glycerin: 9
Castor oil: 8
Triethanolamine: 28
Sodium hydroxide: 3
EDTA . 2Na: 0.1
Purified water: 10
Ethanol: 6

A fluid soap base was obtained, according to usual method, from the above-mentioned ingredients except the soybean phospholipid and 2-octyldodecyl myristate, and the soap base thus obtained was then mixed with the soybean phospholipid and 2-octyldodecyl myristate to obtain a uniform mixture. This mixture was poured into a molding frame and, after cooling to solidity, the solidified soap base was stamped and then given the finishing touch to obtain transparent soap. The transparent soap thus obtained was found to be less irritative and make the skin feel smooth after use.

EXAMPLE 6

(Transparent soap)

Soybean phospholipid: 1%
2-octyldodecyl oleate: 0.5
Beef tallow: 22
Coconut oil: 9

Olive oil: 7.5
Sodium hydroxide: 6
Ethyl alcohol: 18
Sucrose: 9
Glycerin: 6
Perfume: 1
Coloring matter: Suitable amount
EDTA . 2Na: Suitable amount
Purified water: 20

A soap base was obtained, according to the usual method, from the above-mentioned ingredients except the soybean phospholipid and 2-octyldodecyl oleate. In this case, a solution of the soybean phospholipid in 2-octyldodecyl oleate was incorporated, prior to color mixing and scenting steps, into the soap base. The thus obtained transparent soap was found to be less irritative and also favorable to the feel after use.

EXAMPLE 7

(Toilet soap)

Soap base: 92.5%
Soybean phospholipid: 5
2-octyldodecyl ricinoleate: 2.5
EDTA . 2Na: Suitable amount
B H T: Suitable amount
Perfume: Suitable amount A solution of the soybean phospholipid in the 2-octyldodecyl ricinoleate was incorporated, prior to scenting step, into the soap base to obtain toilet soap. The thus obtained toilet soap was found to have the expected effect.

EXAMPLE 8

(Transparent soap)

Egg phospholipid (Egg oil): 0.5%
2-octyldodecyl oleate: 0.25
Stearic acid: 14
Palmitic acid: 4
Beef tallow: 15
Castor oil: 3.15
Coconut oil: 10
B H T: 0.1
Glycerin: 9
Triethanolamine: 27
Sodium hydroxide: 3
Ethanol: 4
Purified water: 10

Following a procedure similar to that of Example 6 and using the solution of the egg phospholipid in the 2-octyldodecyl oleate, transparent soap was obtained. The thus obtained soap was found to be less irritative and an excellent to the feel after use.

EXAMPLE 9

(Toilet soap)

Soybean phospholipid: 1.0%
2-Octyldodecyl oleate: 1.0
Sodium N-acylglutamate: 82.0
Cetanol: 2.0
E D T A: Suitable amount
Purified water: Suitable amount A solution of soybean phospholipid in 2-octyldodecyl oleate together with sodium N-acylglutamate, purified water and the other additives were put into a mixer and stirred thoroughly. The resulting mixture was pressed together by kneading and pressing with a roll plodder to form a cylindrical soap and then cooled, dried and packaged. The toilet soap thus obtained was found to have both characteristics of sodium N-acylglutamate and soy phospholipid and give an excellent feel after its use.

EXAMPLE 10

(Transparent soap)

Soybean phospholipid: 0.5%
2-Octyldodecyl myristate: 0.5
Beef tallow: 22%
Olive oil: 7.5
Lauric acid: 5
Myristic acid: 10
Sodium N-acylglutamate: 2
Sodium hydroxide: 6
Ethyl alcohol: 18
Glycerin: 6
Sucrose: 9
Coloring matter: Suitable amount
EDTA . 2Na: Suitable amount
Perfume: Suitable amount
Purified water: 13.5

A transparent soap was obtained, according to usual method, from the above-mentioned ingredients except that a solution of soybean phospholipid in 2-octyldodecyl myristate was incorporated, prior to color mixing and scenting steps, into the soap which was cooled to 60°-70° C. The thus obtained transparent soap was found to lather well and give a high detergency and an excellent feel after its use.

Having now fully described the invention, it will be apparent to one of ordinary skill in the art that many changes and modifications can be made thereto without departing from the spirit of the invention as set forth herein.

What is claimed as new and intended to be covered by Letters Patent is:

1. A soap composition, comprising a blend of (i) a solid soap base; (ii) a phospholipid; and (iii) a fatty acid ester selected from the group consisting of 2-octyl-dodecyloleate, 2-octyl-dodecylmyristate, 2-octyl-dodecylricinoleate and hexyldecyl dimethyloctanoate;

wherein about 0.1 to 10% by weight of said phospholipid, which as been premixed with about 0.1 to about 5% by weight of said fatty acid ester is dispersed in said soap base.

2. The soap composition of claim 1, wherein said fatty acid ester is 2-octyl-dodecyloleate.

* * * * *